US011819180B2

(12) United States Patent
Hinton

(10) Patent No.: US 11,819,180 B2
(45) Date of Patent: Nov. 21, 2023

(54) HANDHELD VACUUM WITH DISPOSABLE WASTE COLLECTION BAG

(71) Applicant: Marcella Hinton, Long Beach, CA (US)

(72) Inventor: Marcella Hinton, Long Beach, CA (US)

( * ) Notice: Subject to any disclaimer, the term of this patent is extended or adjusted under 35 U.S.C. 154(b) by 0 days.

(21) Appl. No.: 17/857,376

(22) Filed: Jul. 5, 2022

(65) Prior Publication Data

US 2023/0023658 A1 Jan. 26, 2023

Related U.S. Application Data

(60) Provisional application No. 63/225,704, filed on Jul. 26, 2021.

(51) Int. Cl.

| | |
|---|---|
| ***A47L 1/09*** | (2006.01) |
| ***A47L 5/24*** | (2006.01) |
| ***A47L 9/02*** | (2006.01) |
| ***A47L 9/14*** | (2006.01) |

(52) U.S. Cl.

CPC ..... *A47L 9/1481* (2013.01); *A47L 5/24* (2013.01); *A47L 9/02* (2013.01); *A47L 9/1427* (2013.01)

(58) Field of Classification Search

CPC ..... A47L 9/1481; A47L 9/1427; A47L 9/14; A47L 9/1454; A47L 9/1445; A47L 9/02; A47L 9/2884; A47L 9/322; A47L 9/2857; A47L 5/24; A47L 7/0085; A01K 23/005; E01H 1/1206; B01D 46/02

USPC ..... 15/344, 330, 324, 353; 294/1.3

See application file for complete search history.

(56) References Cited

U.S. PATENT DOCUMENTS

| | | | | |
|---|---|---|---|---|
| 4,175,352 | A * | 11/1979 | Catlett | A47L 5/24 15/342 |
| 7,404,230 | B1 * | 7/2008 | Phillips | E01H 1/1206 15/353 |
| 8,196,980 | B1 * | 6/2012 | Banks | E01H 1/1206 294/1.3 |
| 9,920,494 | B2 * | 3/2018 | Rivadeneira | A47L 9/1436 |
| 11,274,407 | B1 * | 3/2022 | James | E01H 1/1206 |
| 2007/0163075 | A1 * | 7/2007 | Butler | A47L 9/04 15/350 |
| 2008/0030032 | A1 * | 2/2008 | Gill | E01H 1/0836 294/1.3 |
| 2012/0186037 | A1 * | 7/2012 | Reynolds | E01H 1/0836 15/257.1 |
| 2012/0216494 | A1 * | 8/2012 | Schultink | A47L 9/1445 55/378 |
| 2018/0044869 | A1 * | 2/2018 | Rosa | E01H 1/1206 |
| 2018/0332824 | A1 * | 11/2018 | Benoit | E01H 1/0836 |
| 2020/0383544 | A1 * | 12/2020 | Conrad | A47L 5/225 |
| 2021/0007563 | A1 * | 1/2021 | Bagwell | A47L 9/127 |

* cited by examiner

*Primary Examiner* — Brian D Keller
*Assistant Examiner* — Tim Brady
(74) *Attorney, Agent, or Firm* — Nixon Peabody LLP

(57) ABSTRACT

Described herein is a vacuum device. In various embodiments, the vacuum device includes a vacuum housing; a motor housing coupled to the vacuum housing; a motor disposed in the motor housing and configured to apply suction toward the vacuum housing; an inlet nozzle releasably coupled to a side of the vacuum housing and configured to receive a waste material; and a disposable vacuum bag disposed in the vacuum housing and configured to receive the waste material that passes through the inlet nozzle.

20 Claims, 3 Drawing Sheets

HANDHELD VACUUM WITH DISPOSABLE WASTE COLLECTION BAG

CROSS-REFERENCE TO RELATED APPLICATIONS

This application includes a claim of priority under 35 U.S.C. § 119(e) to U.S. provisional patent application No. 63/225,704, filed Jul. 26, 2021, the entirety of which is hereby incorporated by reference.

TECHNICAL FIELD

This disclosure relates to a handheld vacuum cleaner, and more particularly, to a vacuum device having a disposable waste/vacuum bag for easy and convenient collection/disposal of animal feces.

BACKGROUND

People with pets inevitably must pick up their pets' waste while on a walk outdoors. Typically, pet waste is picked up using a plastic bag and then thrown away to a trash receptacle. Picking up and carrying pet waste can be frustrating and unsanitary. Although a readily available handheld vacuum cleaner may be used by a user to pick up pet feces, the vacuum cleaners will be contaminated by the pet feces. In general, handheld vacuum cleaners are equipped with a re-usable waste collection bag and the waste collection bag needs to be washed if pet waste is emptied from the waste collection bag. Moreover, handheld vacuum cleaners without a waste collection bag have a waste collection chamber and the chamber will be contaminated by the pet feces even if it is emptied. Even if handheld vacuum cleaners are equipped with a disposable waste collection bag, there is lack of a simple mechanism to easily eject or discard the collection bag containing pet waste. Therefore, a need exists for a mechanism or device that collects and discards pet waste easily and sanitarily.

SUMMARY

Disclosed herein, generally, are portable vacuum devices and a method of using the vacuum device. For example, a handheld vacuum device is designed to conveniently pick up waste by suctioning it into a disposable bag that can be easily ejected from the device. This handheld vacuum device has a mechanism for easily removing the bag once the waste is collected in the bag or when the bag is full such that the waste bag containing pet waste can be disposed immediately in a trash receptacle. Thus, according to one benefit of the present disclosure, the inventive handheld vacuum eliminates the need to pick up pet waste by hand. In other words, there is no contact between a person and the waste or waste bag. The handheld vacuum provides a contactless manner of removing waste both from the environment and the handheld vacuum itself.

In various exemplary embodiments, the vacuum device includes a vacuum housing having a first vacuum side and an opposing second vacuum side; a motor housing having a first motor side and a second motor side, the first motor side being coupled to the second vacuum side; a motor disposed in the motor housing and configured to apply suction toward the vacuum housing; an inlet nozzle releasably coupled to the first vacuum side and configured to receive a waste material; and a disposable vacuum bag disposed in the vacuum housing and configured to receive the waste material that passes through the inlet nozzle.

In some embodiments, the vacuum device further includes a handle formed on or coupled to the second motor side. In some embodiments, the vacuum device further includes a carabiner or coupler formed at either a portion of the handle or at a portion of the motor housing, the carabiner or coupler being formed such that a leash clip of a leash can be coupled to the carabiner or coupler.

In some embodiments, the vacuum device further includes a rechargeable battery disposed in the motor housing. In some embodiments, the vacuum device further includes a power switch configured to receive user input such that the motor is turned on/off in response to the user input.

In some embodiments, the vacuum device further includes an opener configured to open the inlet nozzle in response to user input received via the opener. In some embodiments, at least a portion of the vacuum bag is disposed in the inlet nozzle when the inlet nozzle is not open. In some embodiments, the opener is disposed at a portion of the motor housing or at a portion of the vacuum housing. In some embodiments, at least a portion of the inlet nozzle is coupled to the vacuum housing while the inlet nozzle is open.

In some embodiments, the inlet nozzle is coupled to the vacuum housing by a hinge structure. In some embodiments, the vacuum device further includes a fastener configured to fasten the inlet nozzle to the vacuum housing when the inlet nozzle is closed.

In some embodiments, the vacuum bag is ejectable from the vacuum housing when the inlet nozzle is open. In some embodiments, when the ejected vacuum bag is replaceable with a new vacuum bag, the inlet nozzle being closed to keep the new vacuum bag in the vacuum housing.

In some embodiments, the vacuum device further includes a fan rotated by the motor to generate suction power. In some embodiments, the fan is rotatable in two different directions based on an input received from a user.

In some embodiments, the vacuum bag includes a bag portion and a mouth portion coupled to an opening of the bag portion. In some embodiments, the bag portion is made of a breathable or air filter material, and the mouth portion is made of plastic or paper. For example, the breathable or air filter material includes a paper material or polyester material.

In some embodiments, the mouth portion of the vacuum bag includes a through-hole and a door configured to block or open the through-hole. In some embodiments, the door is in an open configuration when the vacuum device is powered on and is in a closed configuration when the vacuum device is powered off. In some embodiments, the door is configured to open in only one direction toward inside of the bag portion. In some embodiments, the door is a swinging door comprising two door pieces configured to be open when the vacuum device is powered on.

In various exemplary embodiments, the vacuum device includes a vacuum housing; a replaceable vacuum bag disposed in the vacuum housing; a motor housing coupled to the vacuum housing and enclosing a motor configured to apply suction toward the vacuum housing; and an inlet nozzle releasably coupled to the vacuum housing and configured to receive a waste material, the waste material collected in the vacuum bag. The vacuum bag with the waste material therein is ejectable from the vacuum housing in response to opening of the inlet nozzle. The inlet nozzle is closeable when a new vacuum bag is placed in the vacuum housing.

In some embodiments, the vacuum device further includes an opener configured to open the inlet nozzle in response to user input received via the opener. In some embodiments, at least a portion of the vacuum bag is disposed in the inlet nozzle when the inlet nozzle is not open. In some embodiments, the opener is disposed at a portion of the motor housing or at a portion of the vacuum housing. In some embodiments, at least a portion of the inlet nozzle is coupled to the vacuum housing while the inlet nozzle is open to eject the vacuum bag. In some embodiments, the inlet nozzle is coupled to the vacuum housing by a hinge structure.

In various embodiments, the method of using the vacuum device includes placing the inlet nozzle around a waste material; turning on the vacuum device in response to user input received via the power switch to suck up the waste material; and releasing the disposable vacuum bag containing the waste material from the vacuum housing in response to user input received via the opener. In some embodiments, the vacuum bag is released without being touched by the user.

The details of one or more embodiments of the invention are set forth in the accompanying drawings and the description below. Other features, objects, and advantages of the invention will be apparent from the description and drawings, and from the claims.

DETAILED DESCRIPTION

Figure 1B:
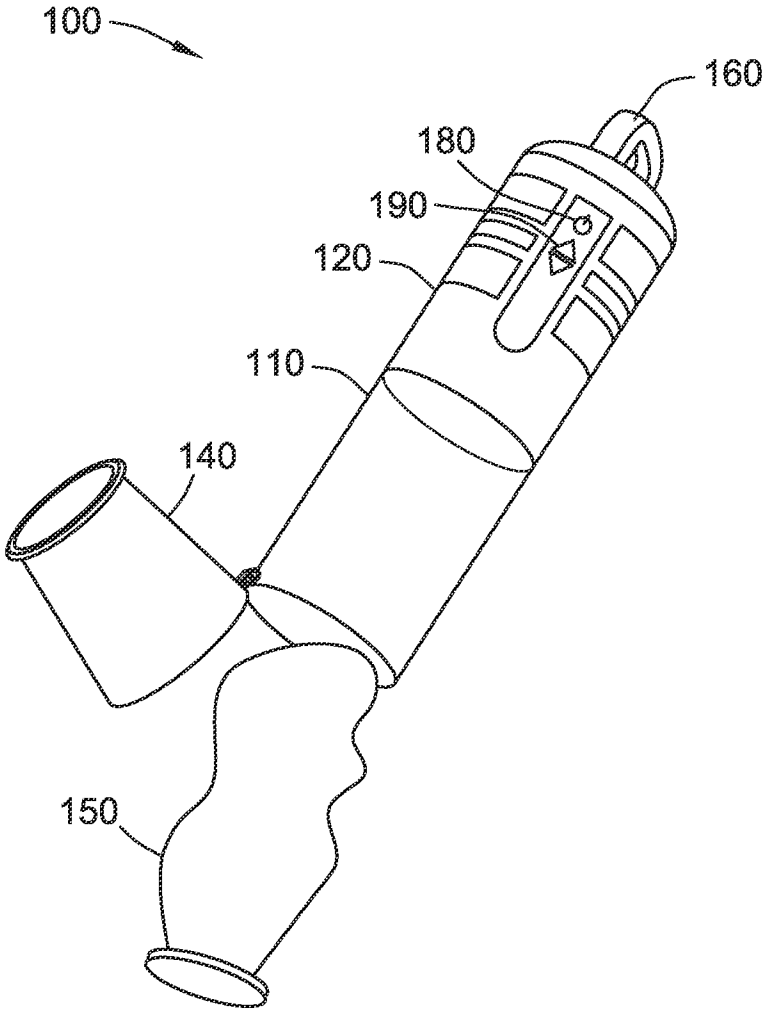
FIG. 1B is a perspective view of the vacuum device shown in FIG. 1A with its inlet nozzle open to eject a vacuum bag from a vacuum housing according to an embodiment of the present disclosure.
Figure 1A:
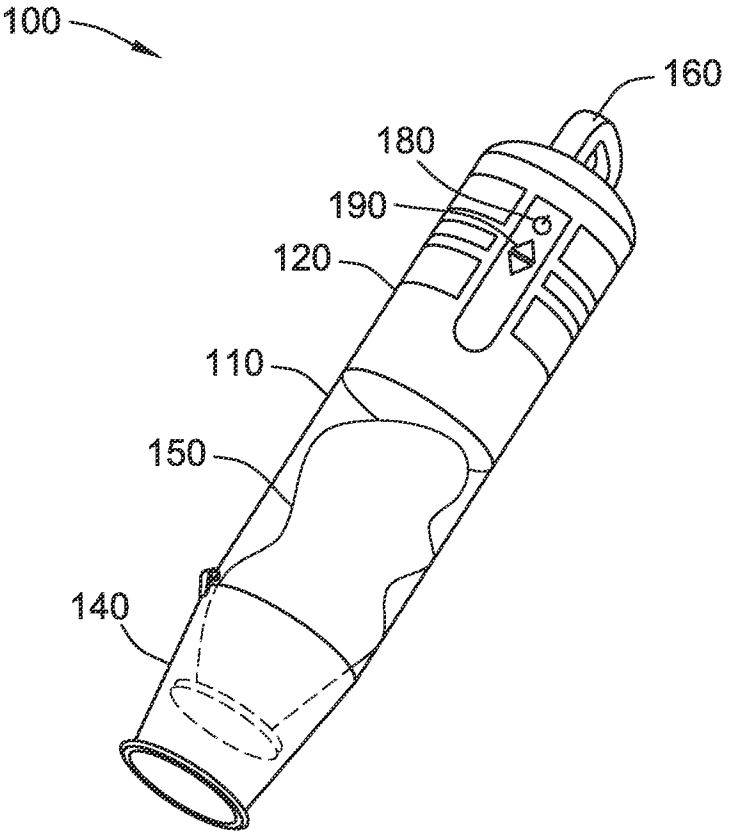
FIG. 1A is a perspective view of a vacuum device according to an embodiment of the present disclosure.

All references cited herein are incorporated by reference in their entirety as though fully set forth. Unless defined otherwise, technical and scientific terms used herein have the same meaning as commonly understood by one of ordinary skill in the art to which this invention belongs.

Referring generally to FIGS. 1A, 1B, 2A, and 2B, according to various embodiments of the present invention, a vacuum device 100 is portable and has a handle 160. In general, the vacuum device 100 is made of light weight material(s) for easy portability. The vacuum device 100 is largely divided into three parts, a motor housing 120 enclosing various electric components, a vacuum housing 110 coupled to the motor housing 120 and enclosing a disposable vacuum bag/waste container 150, and an inlet nozzle 140 detachably coupled to the vacuum housing 110. In this disclosure, the terms "vacuum bag" and "waste container" are used interchangeably.

According to some embodiments, an exhaust port is formed at the motor housing 120 for continuous air flow into the vacuum bag 150 when the vacuum device 100 is powered on. According to some embodiments, a power switch 180 for turning on/off the vacuum device 100 and an opener 190 for opening the inlet nozzle 140 are also formed on the motor housing 120. According to alternative embodiments, the power switch 180 and opener 190 are on a location other than the motor housing 120. According to some embodiments, the vacuum device 100 is turned on in response to a first input received via the power switch 180 and turned off in response to a second input received via the power switch. According to alternative embodiments, the vacuum device 100 is in a turned-on state while the power switch 180 is being pressed by a user such that the vacuum device 100 is turned off when the user no longer presses the power switch.

When the vacuum device 100 is powered on via the power switch 180, the device can suck up waste/dust through an opening of the inlet nozzle 140. For example, the waste is animal feces and the opening of the inlet nozzle 140 is shaped and sized to accommodate the animal feces. In some embodiments, the opening of the inlet nozzle 140 is large enough to receive animal feces by quick single suction. In some embodiments, the inlet nozzle 140 does not need to contact the animal feces when the feces are sucked into the vacuum bag 150. For example, the opening of the inlet nozzle 140 may be placed such that animal feces are positioned substantially in the middle of the opening, thus avoiding the inlet nozzle being in direct contact with the animal feces. The vacuum device 100 may be turned on before or after the inlet nozzle 140 is placed to pick up the animal feces. Once the waste/animal feces is sucked up through the inlet nozzle 140, the waste enters the vacuum bag 150 and is kept inside the vacuum bag until it is vacated. According to some embodiments, the vacuum bag 150 is waterproof since animal feces may be semisolid or include liquid. In some embodiments, the vacuum bag 150 is made of recycled materials.

Referring to FIG. 1B, the vacuum bag 150 containing the waste is ejectable from the vacuum housing 110 in response to user input received via the opener 190. That is, the inlet nozzle 140 is open in response to the user input, and the vacuum bag 150 is ejected when the inlet nozzle 140 opens. Thus, a user can discard the vacuum bag 150 directly into a trash receptacle by pointing the inlet nozzle 140 toward an opening of the trash receptacle and pushing and/or sliding the opener 190 to open the inlet nozzle 140. In some embodiments, opening of the inlet nozzle 140 is motorized. Therefore, the user does not need to use his/her hands to take out the vacuum bag 150 from the vacuum housing 110. That is, the disposable vacuum bag 150 can be discarded in a single step without being touched by the user. Once the vacuum bag 150 is ejected, a new disposable vacuum bag 150 is placed in the vacuum housing 110, and the inlet nozzle 140 is closed. Thus, no cleaning of the vacuum device 100 is necessary.

Optionally, user input received via the opener 190 triggers a pushing mechanism such that the vacuum bag 150 is pushed out when the inlet nozzle 140 is open. Even if the pushing mechanism is not triggered, the vacuum bag 150 will come out of the vacuum housing 110 by gravity when the opening of the vacuum housing is facing downward and when the inlet nozzle 140 is open in response to the user input received via the opener 190.

In some embodiments, the inlet nozzle 140 is releasably coupled to the vacuum housing 110 by a hinge 141, 111. In some embodiments, a first portion 111 of the hinge is formed at one side of the vacuum housing 110 and a second portion 141 of the hinge is formed at one side of the inlet nozzle 140, as exemplified in FIGS. 2A and 2B. In some embodiments, a latch is formed at the other side of the vacuum housing 110, for example, at an opposite side of the side at which the hinge 141, 111 is formed. Thus, even when the inlet nozzle 140 is open, at least a portion of the inlet nozzle is still coupled to the side of the vacuum housing 110. In some embodiments, the hinge 141, 111 further includes a spring member configured to maintain the inlet nozzle 140 in an open state once it is open in response to the user input received via the opener 190 such that the vacuum bag 150 can be ejected from the vacuum housing 110. In some embodiments, the inlet nozzle 140 needs to be pressed to be closed.

Figure 2A:
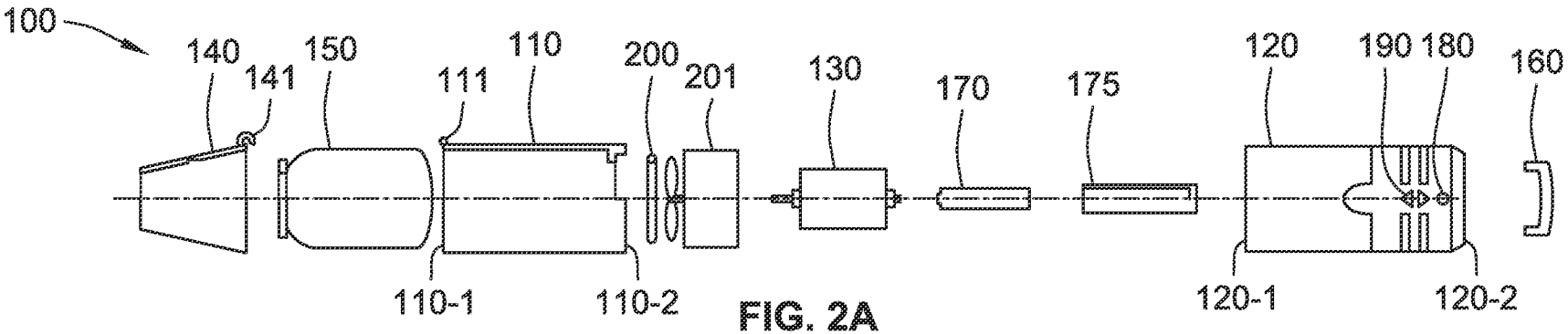
FIG. 2A is an exploded view of a vacuum device according to an embodiment of the present disclosure.
Figure 2B:
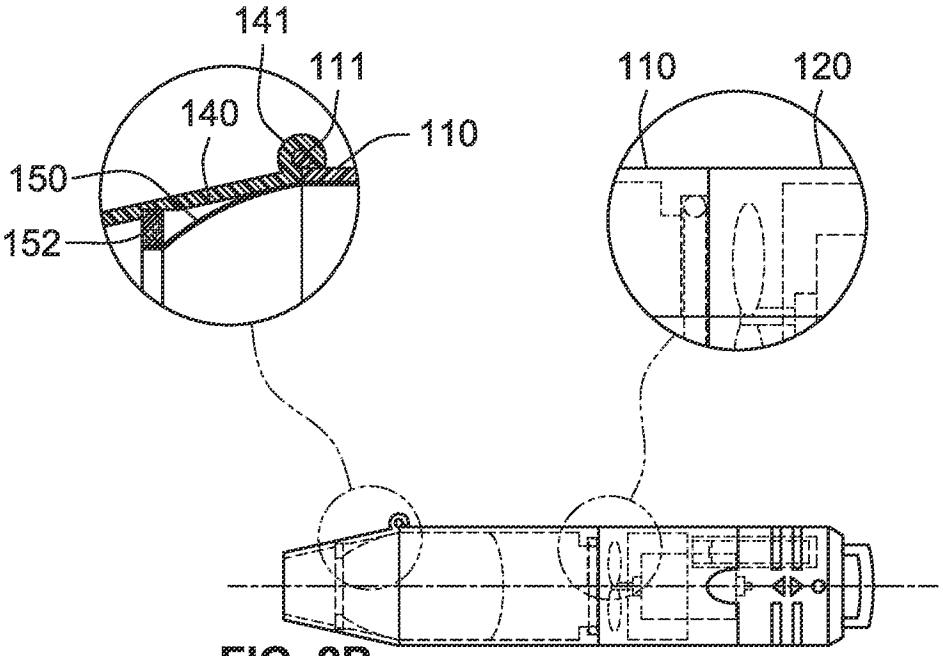
FIG. 2B includes a section view of a vacuum housing and an inlet nozzle housing a vacuum bag and a section view of the vacuum housing and a motor housing according to an embodiment of the present disclosure.

Referring to FIG. 2A, for example, components such as a fan 200, a motor 130, a battery 170 are enclosed within the motor housing 120. The vacuum housing 110 has a first side 110-1 and an opposing second side 110-2, as shown in FIGS. 1A-2A. The motor housing 120 has a first side 120-1 coupled to the second side of the vacuum housing 110 and a second side 120-2. A motor 130 is disposed in the motor housing 120 and configured to apply suction toward the vacuum housing 110. The inlet nozzle 140 is releasably coupled to the first side 110-1 of the vacuum housing 110 and configured to receive a waste material. When the vacuum device 100 is turned on, the disposable vacuum bag 150 disposed in the vacuum housing 110 is configured to receive the waste material that passes through the inlet nozzle 140. A used vacuum bag 150 can be ejected and replaced with a new one by opening the inlet nozzle 140.

In some embodiments, the vacuum device 100 further includes a handle 160 formed on or coupled to the second side 120-2 of the motor housing 120. In some embodiments, the vacuum device 100 further includes a carabiner or coupler formed at a portion of the handle 160 or motor housing 120 such that a leash clip of an animal leash can be coupled to the carabiner or coupler. In some embodiments, the vacuum device 100 further includes a rechargeable battery 170 disposed in the motor housing 120. In some embodiments, the battery 170 is enclosed in a battery holder 175. In some embodiments, the battery 170 is removable and charged at an external charger. In some embodiments, the vacuum device 100 further includes a power switch 180 configured to receive user input such that the motor 130 is turned on/off in response to the user input. In some embodiments, the vacuum device 100 further includes an opener 190 configured to open the inlet nozzle 140 in response to user input received via the opener 190. In some embodiments, the opener 190 is disposed at a portion of the motor housing 120. In some embodiments, the opener 190 is disposed at a portion of the vacuum housing 110.

As shown in FIG. 1B, at least a portion of the inlet nozzle 140 is coupled to the vacuum housing 110 while the inlet nozzle 140 is open. In some embodiments, the inlet nozzle 140 is coupled to the vacuum housing 110 by a hinge structure 111, 141 shown in FIGS. 2A and 2B. In some embodiments, the vacuum device 100 further includes a fastener configured to fasten the inlet nozzle 140 to the vacuum housing 110 when the inlet nozzle 140 is closed. The vacuum bag 150 is ejected from the vacuum housing 110 when the inlet nozzle 140 is open. The ejected vacuum bag 150 is replaced with a new vacuum bag 150, and the inlet nozzle 140 is closed to keep the new vacuum bag 150 in the vacuum housing 110.

Referring to FIG. 2A, in some embodiments, the vacuum device 100 further includes a fan 200 rotated by the motor 130 to generate suction power. In some embodiments, the fan 200 is enclosed by a fan cage 201. In some embodiments, the fan 200 can be rotated in both directions in response to user inputs for setting a rotation direction. For example, when the fan 200 rotates in a first direction, suction power is generated, and when the fan rotates in a second direction, which is the opposite direction of the first direction, the fan generates wind toward the vacuum housing 110 such that the wind pushes out the vacuum bag 150 from the vacuum housing toward the inlet nozzle 140. Thus, when the inlet nozzle 140 is open and when the wind is generated by the fan 200 rotating in the second direction, ejection of the vacuum bag 150 is facilitated. In some embodiments, the fan 200 is configured to rotate in the second direction when the inlet nozzle 140 is open in response to user input received via the opener 190.

Figure 3C:
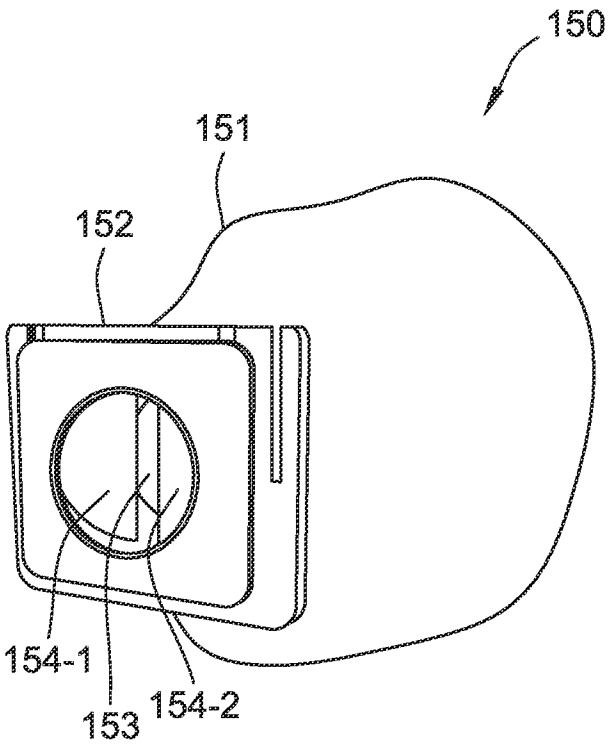
FIG. 3C is a front perspective view of the vacuum bag of FIG. 3B with the door in an open configuration.
Figure 3B:
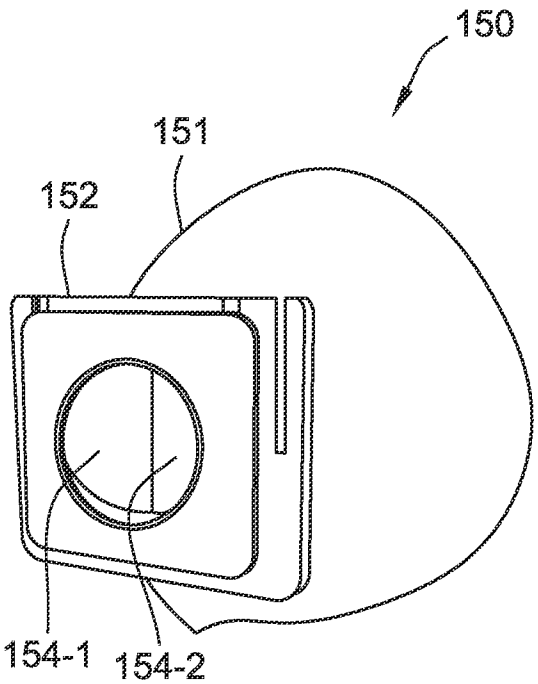
FIG. 3B is a front perspective view of the vacuum bag of FIG. 3A with a door in a closed configuration.
Figure 3A:
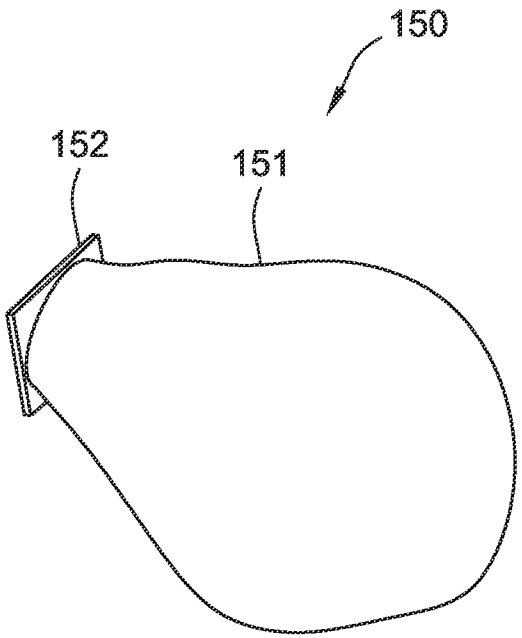
FIG. 3A is a side perspective view of a vacuum bag for a vacuum device according to an embodiment of the present disclosure.

Referring to FIGS. 3A-3C, the vacuum bag 150 includes a bag portion 151 and a mouth portion 152 coupled to an opening of the bag portion 151. In some embodiments, the bag portion 151 is made of a recycled/recyclable material. In some embodiments, the bag portion 151 is made of a breathable or air filter material. In some embodiments, the breathable or air filter material includes porous paper, cloth or polyester. In some embodiments, the mouth portion 152 is made of plastic or paper. In some embodiments, the mouth portion 152 of the vacuum bag 150 contacts an inner side of the inlet nozzle 140. In some embodiments, at least a portion of the mouth portion 152 is shaped to fit in the inlet nozzle 140. In some embodiments, the mouth portion 152 of the vacuum bag 150 is closely located to an opening of the inlet nozzle 140 such that waste received via the opening of the inlet nozzle 140 immediately passes through the mouth portion to avoid contaminating the inlet nozzle. In some embodiments, the inlet nozzle 140 has an inner portion configured to removably couple to the mouth portion 152 of the vacuum bag 150. In some embodiments the mouth portion 152 of the vacuum bag 150 is loosely coupled to the inner portion of the inlet nozzle 140 such that the inlet nozzle is uncoupled from the mouth portion of the vacuum bag when the inlet nozzle is open in response to user input received via the opener 190.

Referring to FIGS. 3B and 3C, the mouth portion 152 of the vacuum bag 150 includes a through-hole 153 and a door 154 configured to block or open the through-hole 153. For example, as shown in FIG. 3B, the door 154 is in a closed configuration when the vacuum device 100 is powered off, and as shown in FIG. 3C, the door 154 is in an open configuration when the vacuum device 100 is powered on. In some embodiments, the door 154 is configured to open in only one direction toward inside of the bag portion 151. Due to the suction power while the door 154 is open, waste collected in the vacuum bag 150 does not fall out of the vacuum bag 150 even if the mouth portion 152 is directed downward. After the waste is collected in the vacuum bag 150, the door 154 is closed when the vacuum device 100 is powered off. Thus, the through-hole 153 will be blocked by the door 154 in the off state, preventing the collected waste to fall out of the vacuum bag 150. In some embodiments, the door 154 is a swinging door comprising two door pieces 154-1, 154-2 configured to open when the vacuum device 100 is powered on. In some embodiments, while the two door pieces 154-1, 154-2 can be open inwardly, they cannot be open outwardly. For example, the through-hole 153 is circular, and each door piece 154-1, 154-2 is semi-circular. However, the shapes of the through-hole 153 and the door 154 are not limited thereto and may be in different shapes, for example, in a shape of a square. In some embodiments, when the door 154 is closed, straight lines of the door pieces 154-1, 154-2 are aligned such that the through-hole 153 is completely closed.

Although the disclosed embodiments have been illustrated and described with respect to one or more implementations, equivalent alterations and modifications will occur or be known to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

While various embodiments of the present disclosure have been described above, it should be understood that they have been presented by way of example only, and not limitation. Numerous changes to the disclosed embodiments can be made in accordance with the disclosure herein, without departing from the spirit or scope of the disclosure. Thus, the breadth and scope of the present disclosure should not be limited by any of the above described embodiments. Rather, the scope of the disclosure should be defined in accordance with the following claims and their equivalents.

What is claimed is:

1. A vacuum device comprising:

a vacuum housing having a first vacuum side and an opposing second vacuum side;

a motor housing having a first motor side and a second motor side, the first motor side being coupled to the second vacuum side;

a motor disposed in the motor housing and configured to apply suction toward the vacuum housing;

an inlet nozzle releasably coupled to the first vacuum side and configured to receive a waste material; and a disposable vacuum bag disposed in the vacuum housing and configured to receive the waste material that passes through the inlet nozzle, wherein at least a portion of the vacuum bag is disposed in the inlet nozzle when the inlet nozzle is not open.

2. The vacuum device of claim 1, further comprising:

a handle formed on or coupled to the second motor side;

a rechargeable battery disposed in the motor housing; and a power switch configured to receive user input such that the motor is turned on/off in response to the user input.

3. The vacuum device of claim 2, further comprising a carabiner or coupler formed at either a portion of the handle or at a portion of the motor housing, the carabiner or coupler being formed such that a leash clip of a leash can be coupled to the carabiner or coupler.

4. The vacuum device of claim 1, further comprising an opener configured to open the inlet nozzle in response to user input received via the opener.

5. The vacuum device of claim 4, wherein:

the opener is disposed at a portion of the motor housing or at a portion of the vacuum housing; and at least a portion of the inlet nozzle is coupled to the vacuum housing while the inlet nozzle is open.

6. The vacuum device of claim 5, wherein the inlet nozzle is coupled to the vacuum housing by a hinge structure.

7. The vacuum device of claim 4, wherein:

the vacuum bag is ejectable from the vacuum housing when the inlet nozzle is open; and the ejected vacuum bag is replaceable with a new vacuum bag, the inlet nozzle being closed to keep the new vacuum bag in the vacuum housing.

8. The vacuum device of claim 1, further comprising a fastener configured to fasten the inlet nozzle to the vacuum housing when the inlet nozzle is closed.

9. The vacuum device of claim 1, further comprising a fan rotated by the motor to generate suction power.

10. The vacuum device of claim 1, wherein the vacuum bag includes a bag portion and a mouth portion coupled to an opening of the bag portion.

11. The vacuum device of claim 10, wherein:

the bag portion is made of a breathable or air filter material, and the mouth portion is made of plastic or paper;

the breathable or air filter material comprises a paper material or polyester material.

12. The vacuum device of claim 10, wherein the mouth portion comprises a through-hole and a door configured to block or open the through-hole, wherein the door is in an open configuration when the vacuum device is powered on and is in a closed configuration when the vacuum device is powered off.

13. The vacuum device of claim 12, wherein the door is configured to open in only one direction toward inside of the bag portion.

14. The vacuum device of claim 12, wherein the door is a swinging door comprising two door pieces configured to be open when the vacuum device is powered on.

15. A vacuum device comprising:

a vacuum housing;

a replaceable vacuum bag disposed in the vacuum housing;

a motor housing coupled to the vacuum housing and enclosing a motor configured to apply suction toward the vacuum housing;

an inlet nozzle releasably coupled to the vacuum housing by a hinge structure and configured to receive a waste material, the waste material collected in the vacuum bag; and an opener disposed at a portion of the motor housing and configured to open the inlet nozzle in response to user input received via the opener, wherein the vacuum bag with the waste material therein is ejectable from the vacuum housing in response to opening of the inlet nozzle, and wherein the inlet nozzle is closeable after a new vacuum bag is placed in the vacuum housing.

16. The vacuum device of claim 15, wherein at least a portion of the inlet nozzle is coupled to the vacuum housing while the inlet nozzle is open to eject the vacuum bag.

17. The vacuum device of claim 15, wherein the user input triggers a pushing mechanism such that the vacuum bag is pushed out of the vacuum housing when the inlet nozzle is open.

18. The vacuum device of claim 15, wherein the hinge structure includes a spring member configured to maintain the inlet nozzle in an open state once the inlet nozzle is open in response to the user input received via the opener.

19. The vacuum device of claim 18, wherein the inlet nozzle is closed in response to pressure applied to the inlet nozzle.

20. A vacuum device comprising:

a vacuum housing;

a replaceable vacuum bag disposed in the vacuum housing;

a motor housing coupled to the vacuum housing and enclosing a motor configured to apply suction toward the vacuum housing; and an inlet nozzle releasably coupled to the vacuum housing and configured to receive a waste material, the waste material collected in the vacuum bag, wherein the vacuum bag with the waste material therein is ejectable from the vacuum housing in response to opening of the inlet nozzle, wherein the inlet nozzle is closeable after a new vacuum bag is placed in the vacuum housing, and wherein at least a portion of the vacuum bag is disposed in the inlet nozzle when the inlet nozzle is not open.

* * * * *